US008472838B2

(12) United States Patent
Numata et al.

(10) Patent No.: US 8,472,838 B2
(45) Date of Patent: Jun. 25, 2013

(54) ELECTROPHOTOGRAPHIC IMAGE FORMING APPARATUS WITH SPACING MEMBER FOR SPACING COMPONENTS OF THE APPARATUS

(75) Inventors: Tetsuya Numata, Suntou-gun (JP); Akira Yoshimura, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 336 days.

(21) Appl. No.: 12/904,453

(22) Filed: Oct. 14, 2010

(65) Prior Publication Data

US 2011/0103826 A1 May 5, 2011

(30) Foreign Application Priority Data

Oct. 30, 2009 (JP) ..... 2009-250060

(51) Int. Cl.
*G03G 15/00* (2006.01)
*G03G 15/01* (2006.01)

(52) U.S. Cl.
USPC ..... 399/111; 399/227

(58) Field of Classification Search
USPC ..... 399/111, 110, 112, 227
See application file for complete search history.

(56) References Cited

U.S. PATENT DOCUMENTS 6,665,507 B1 * 12/2003 Hooper et al. ..... 399/110
7,512,361 B2 3/2009 Kawamura et al.
2005/0025522 A1 2/2005 Tsuzuki et al.
2010/0054799 A1 * 3/2010 Nakamura et al. ..... 399/114
2010/0054805 A1 3/2010 Numata et al.
2010/0054807 A1 3/2010 Takeyama et al.
2011/0103823 A1 5/2011 Ueno et al.
2011/0103825 A1 5/2011 Numata et al.
2011/0103827 A1 5/2011 Uneme et al.

FOREIGN PATENT DOCUMENTS

CN 1854933 A 11/2006
CN 101667004 A 3/2010
JP 63-273878 A * 11/1988
JP 2000-181328 6/2000
JP 2006171407 A 6/2006

OTHER PUBLICATIONS

Office Action in Chinese Patent Application No. 201010529821.6, dated Dec. 19, 2012 (with English translation).

* cited by examiner

*Primary Examiner* — Sophia S Chen
(74) *Attorney, Agent, or Firm* — Fitzpatrick, Cella, Harper & Scinto

(57) ABSTRACT

An electrophotographic image forming apparatus includes a drum cartridge with an image bearing member and charging device for charging a surface of the image bearing member. The apparatus further includes a rotary supporting a plurality of developing devices each having a developer carrying member for developing an electrostatic latent image formed on the image bearing member, with the rotary being swingably mounted to the main assembly of the apparatus through a supporting member and being rotatable, relative to the supporting member, to bring the developing device to a developing position for developing the electrostatic latent image. A spacer member is provided for spacing between the charging device and the surface of the image bearing member, the spacer member being mounted between the image bearing member and the charging device.

5 Claims, 16 Drawing Sheets

ELECTROPHOTOGRAPHIC IMAGE FORMING APPARATUS WITH SPACING MEMBER FOR SPACING COMPONENTS OF THE APPARATUS

FIELD OF THE INVENTION

The present invention relates to an electrophotographic image forming apparatus comprising a drum cartridge, a plurality of developing means, and a rotary (rotatable moving mechanism) including a plurality of mounting portions capable of carrying the developing means. The present invention is particularly suitable to a color electrophotographic image forming apparatus for forming color images on recording materials. Here an electrophotographic image forming apparatus forms the images on recording materials using an electrophotographic image forming process. For example, it includes an electrophotographic copying machine, electrophotographic printer (LED printer, laser beam printer or the like), an electrophotographic printer type facsimile machine, and electrophotographic printer type word processor and so on. The developing cartridge is a cartridge containing as a unit a developer carrying member for developing an electrostatic latent image formed on an image bearing member, and a developer accommodating portion accommodating a developer. A known developer carrying member is a developing roller. In addition, the drum cartridge is a cartridge containing at least charging means and an image bearing member as a unit, which is detachably mountable relative to a main assembly of the apparatus of an electrophotographic image forming apparatus.

In an electrophotographic image forming apparatus (image forming apparatus or apparatus) such as a copying machine, a printer and a facsimile machine, an electrostatic latent image formed on an image bearing member is developed by developing means into a visualized toner image. It is known that in a color electrophotographic image forming apparatus, there is provided a rotary as a rotatable developing means moving mechanism in the main assembly of the apparatus. Four developing cartridges as developing means containing different color developers are detachably mounted to the rotary. The rotary is swingable in the direction of bring a developing roller as the developer carrying member provided in the developing cartridge into contact to an electrophotographic photosensitive member (drum) as an image bearing member in a developing position where the developing roller is opposed to the electrophotographic photosensitive member. The drum cartridge includes a drum cartridge frame supporting the drum and charging means for charging a surface of the drum. In an example of charging means used in an image forming apparatus, there is a contact charging type charging means for charging the surface of the drum in the state that the charging means is in contact with the drum. For example, a charging roller as the charging means is contacted to the surface of the drum to charge the surface of the drum. The charging roller is supported by the drum cartridge frame in the state that it is pressed toward the drum in order to keep contacting to the drum. When, however, the contact between the charging roller and the drum is kept for a long-term, there is a liability that the charging roller deforms. In order to solve such a problem, Japanese Laid-open Patent Application 2000-181328 proposes the charging roller and the drum are kept spaced from each other when the cartridge is not used, particularly during transportation of the cartridge before the drum cartridge reaches the user. In Japanese Laid-open Patent Application 2000-181328, there is provided a spacer member penetrating a drum covering member and locking the covering member relative to the drum cartridge, the spacer member inserted between the charging roller and that drum. By this, the charging roller and the drum are kept spaced from each other during shipment and transportation of the drum cartridge.

Recently, the image forming apparatus is shipped and transported in the state that the drum cartridge and the developing cartridge (developing means) are mounted to the main assembly of the apparatus for the purpose of improving the usability. Then, the user can start the use of the image forming apparatus without taking the drum cartridge and the developing cartridge out and mounting them into the image forming apparatus. In such a case, the rotary is swingably supported by the main assembly of the apparatus, and therefore, an impact during transportation may result in collision to the other parts in the main assembly of the apparatus.

SUMMARY OF THE INVENTION

Accordingly, it is an object of the present invention to provide an image forming apparatus packed together with the drum cartridge and the developing means, wherein a rotary supporting the developing means is prevented from swing during transportation or the like.

It is another object of the present invention to provide an image forming apparatus packed together with a drum cartridge containing charging means, wherein deformation of the charging means attributable to press-contact thereof to the image bearing member. It is a further object of the present invention to provide an image forming apparatus in which the rotary is easily released from a locking for preventing swing motion, and the developer carrying member is easily released from a locking for preventing contact to the image bearing member.

According to an aspect of the present invention, there is provided an electrophotographic image forming apparatus for forming an image on a recording material, said apparatus comprising (i) a drum cartridge including an image bearing member and charging means for charging a surface of said image bearing member, said drum cartridge being demountably mounted to a main assembly of the electrophotographic image forming apparatus; a rotary supporting a plurality of developing means each having a developer carrying member for developing an electrostatic latent image formed on said image bearing member, said rotary being swingably mounted to said main assembly of the apparatus through a supporting member and being rotatable, relative to said supporting member, to bring said developing means to a developing position for developing the electrostatic latent image; (iii) a spacer member for spacing between said charging means and the surface of said image bearing member, said spacer member being mounted between said image bearing member and said charging means; and (iv) a locking member for spacing between said developing means positioned in the developing position and said image bearing member, said locking member being demountably mounted between said drum cartridge and said rotary, and said locking member being is provided with a guide portion for guiding said spacer member between said image bearing member and said charging means.

DESCRIPTION OF THE PREFERRED EMBODIMENTS

Embodiment (General Arrangement of Electrophotographic Image Forming Apparatus)

Figure 7A:
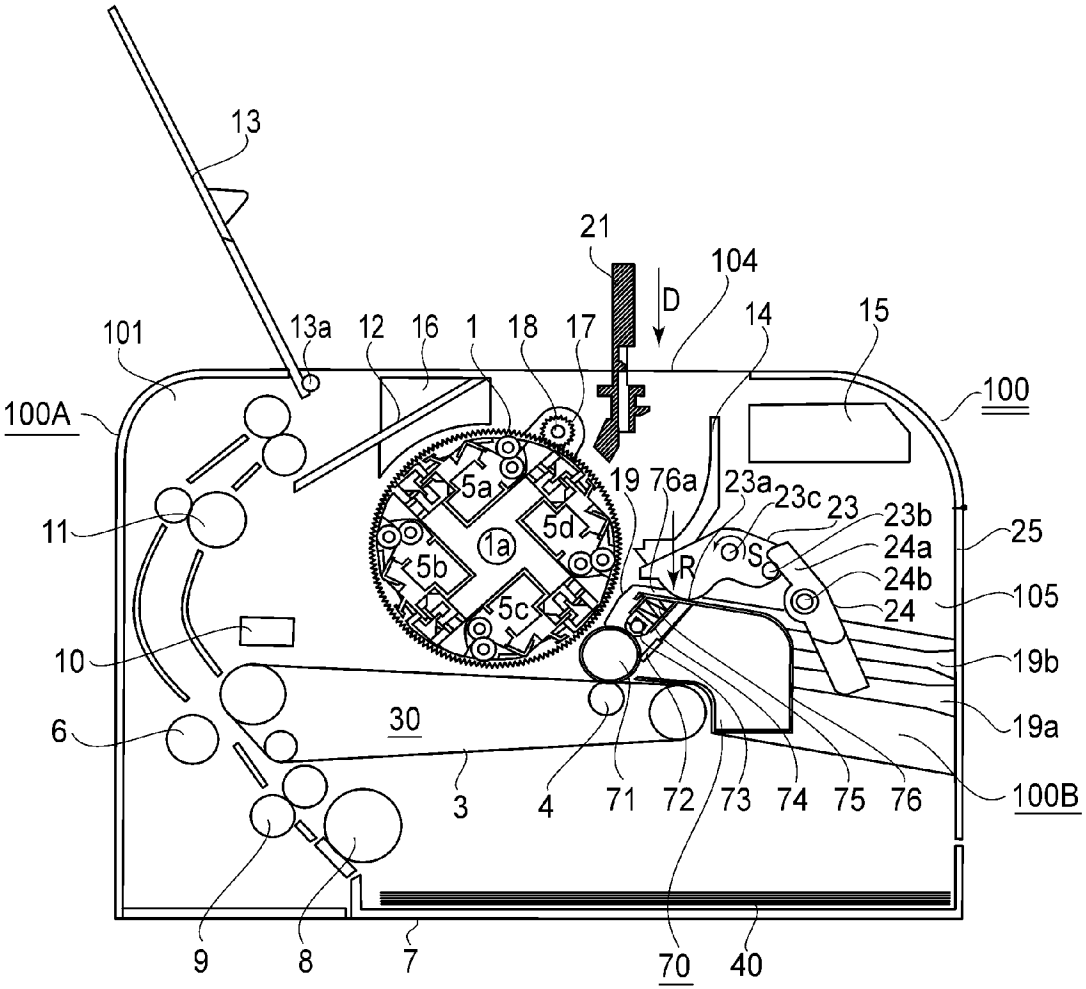
FIG. 7A illustrates a mounting manner of the locking member.

Referring to FIG. 1A, FIG. 1B, FIG. 2A and FIG. 2B, the description will be made as to the structure and image forming operation of the electrophotographic image forming apparatus 100 according to an embodiment of the present invention. The apparatus 100 is a laser beam printer using an electrophotographic process and capable of forming full-color images (four colors). It executes color image forming operation on the recording material 40 in the form of a sheet in response to an electrical image signal inputted to a control circuit portion (unshown) from a host apparatus (unshown) such as a personal computer, an image reader, another facsimile machine or the like. The recording material 40 is recording material, sheet, OHT sheet, label or the like. The control circuit portion (control means: CPU) supplies and receives various electrical information between the host apparatus and an operating portion (unshown), and in addition, effects overall controls of the image forming operation of the apparatus 100 in accordance with predetermined control program, reference table and so on. Therefore, that image forming operations of the apparatus 100 which will be described hereinafter are controlled by the control circuit portion. The apparatus 100 comprises a drum type electrophotographic photosensitive member (drum) 71 as an image bearing member. Around the drum 71, there are provided charging means 73 for uniformly charging the surface of the drum 71, exposure means 15 for forming an electrostatic latent image by exposing the surface of the drum 71 to a laser beam, a development assembly 50. The development assembly 50 includes a plurality of developing means 5 (5*a*, 5*b*, 5*c*, 5*d*) for visualizing the electrostatic latent image formed on the drum 71 with a developer (toner), a rotary 1 as a rotatable moving mechanism provided with a plurality of mounting portions for carrying the developing means 5. There is provided a cleaning means 72 for removing residual toner from the drum 71. The development assembly 50 in this embodiment includes four developing means, namely a yellow developing device 5*a*, a magenta developing device 5*b*, a cyan developing device 5*c*, and a black developing device 5*d*. In the following, yellow, magenta, cyan and black are indicated as Y color, M color, C color and B color, respectively. In this embodiment, the drum 71, the charging means 73 and the cleaning means 72 are integrally formed into a drum cartridge 70 which is detachably mountable to a predetermined mounting portion 100B of the main assembly 100A of the apparatus 100. Here, the main assembly 100A of the apparatus is a structure of the image forming apparatus 100 except for the drum cartridge 70. The developing devices 5 are supported by a rotary 1 which is swingable through supporting members 102L, 102R (FIG. 2B) relative to an apparatus frame 101 of the main assembly 100A of the apparatus and which is rotatable relative to the supporting member 102L, 102R, and the developing devices 5 are arranged around the circumferential direction of the rotary. The developing devices 5 may be fixed to the rotary 1, or may be of a developing cartridge type demountable from the rotary 1. In the case of the stationary type, the toner is supplied from a developer supply portion (unshown) ink to the developer accommodating portion of the developing device. In this embodiment, the developing cartridge type is employed. In such a case, the developing cartridge is exchanged with a new developing cartridge when a display portion (unshown) indicates emptiness of the toner. The developing devices 5*a*, 5*b*, 5*c*, 5*d* are hereinafter called Y color developing cartridge 5*a*, M color developing cartridge 5*b*, C color developing cartridge 5*c*, and B color developing cartridge 5*d*, respectively. In the mounting and demounting of developing cartridge 5 relative to the rotary 1, in this embodiment, an upper cover (mounting and demounting cover) 13 of the upper surface of the main assembly 100A of the apparatus is opened about a hinge portion 13*a* to open the opening 104 of the main assembly 100A of the apparatus as shown in FIG. 7A. Each developing cartridge 5 is mounted and demounted relative to the rotary 1 by way of a predetermined operation process through the opening 104 with the aid of mounting and demounting guides 14. Below the rotary 1, an intermediary transfer belt unit 30 is provided. The unit 30 includes, in the main assembly 100A of the apparatus, a rear side secondary transfer opposing roller 31, a front cover 25 side driving roller 32, a tension roller 33 a primary transfer roller 4, and an endless intermediary transfer belt 3 which has a flexibility a which are stretched around the rollers. The primary transfer roller 4 is urged to the lower surface of the drum 71 with the intermediary transfer belt (belt) 3 therebetween. Below the unit 30, there is provided a cassette 7 accommodating recording material 40 (sheets). The cassette 7 is mounted and demounted from a front side where a front cover 25 is provided.

Figure 1A:
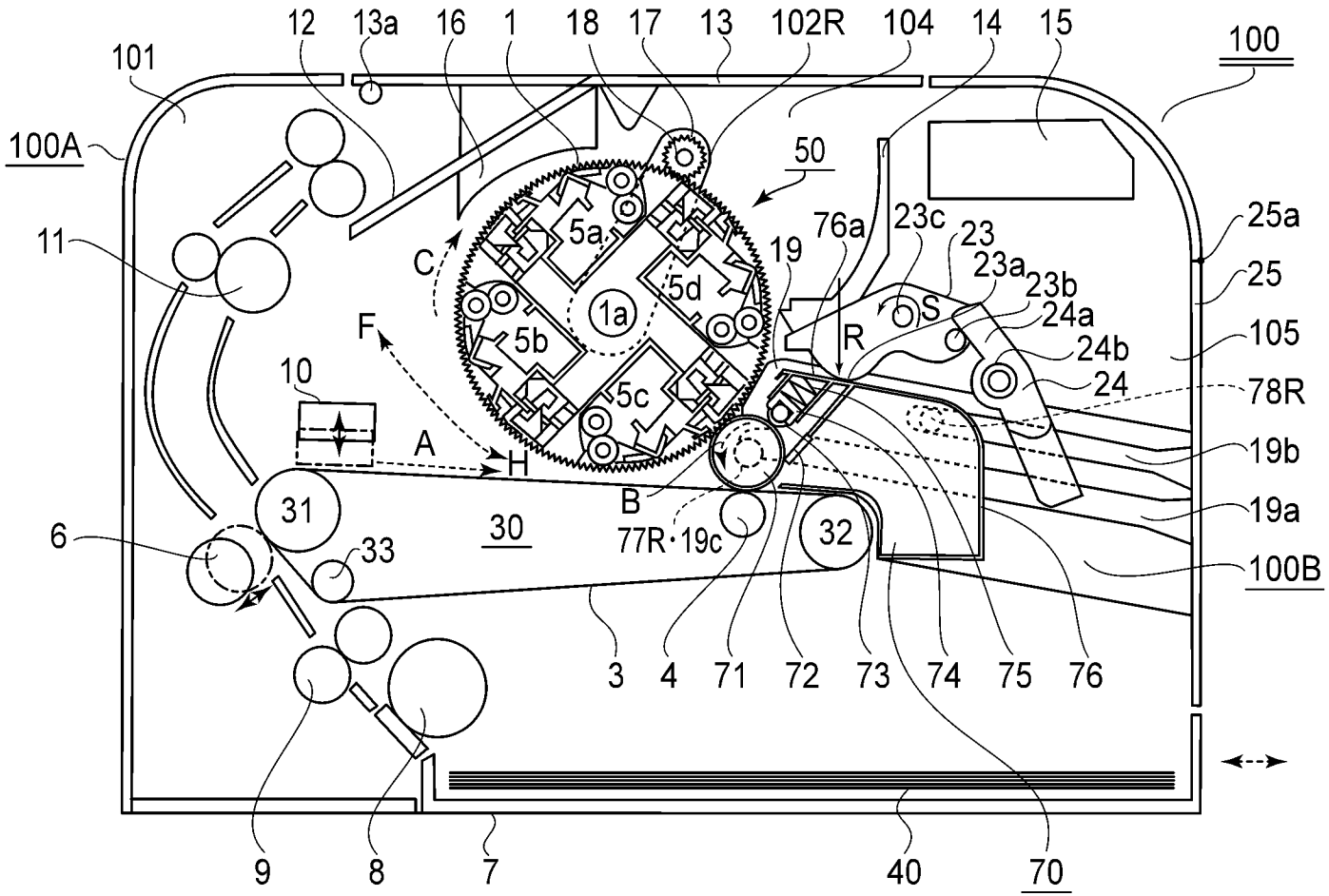
FIG. 1A is a schematic sectional view of an image forming apparatus according to an embodiment of the present invention during a stand-by state.
Figure 1B:
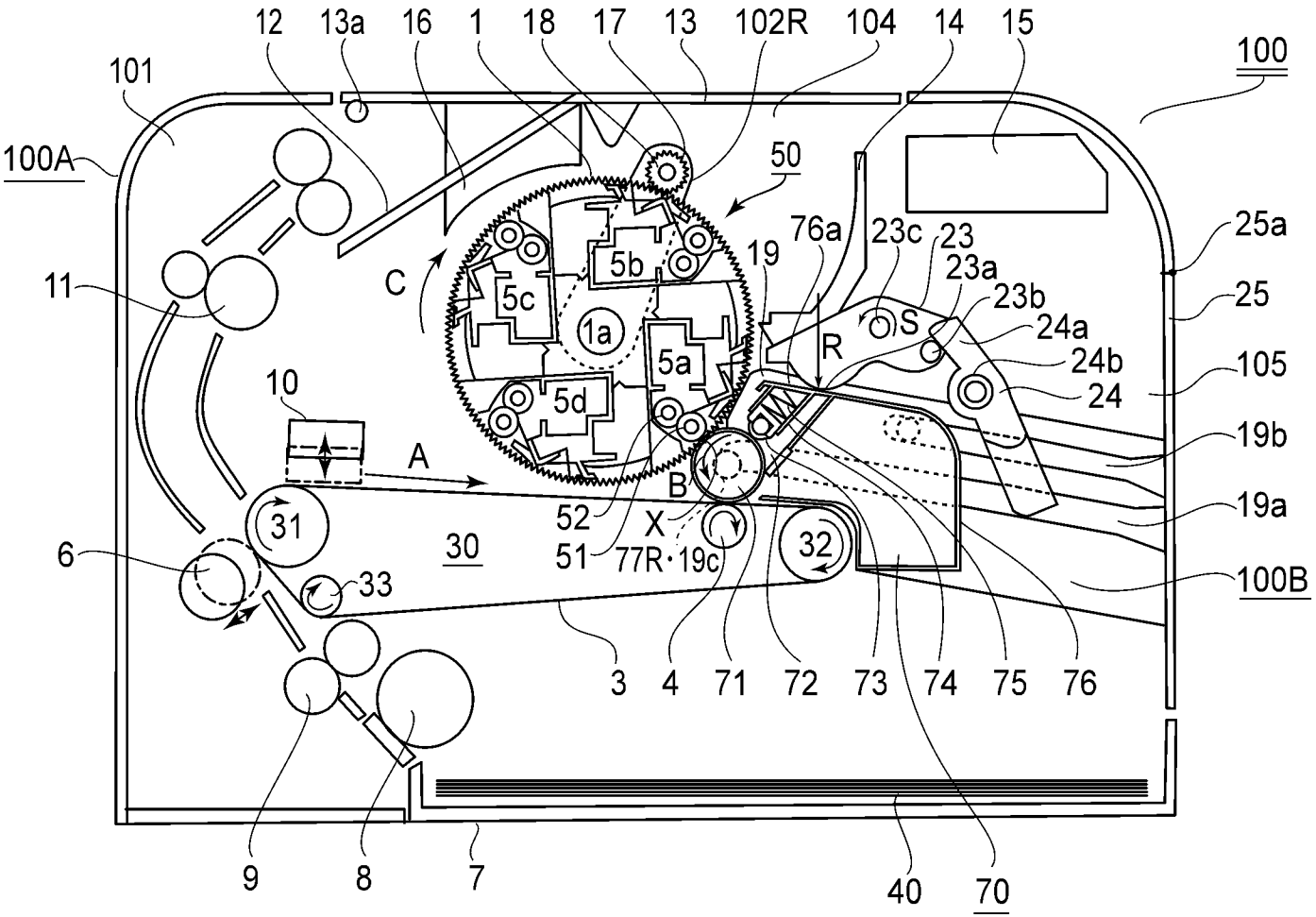
FIG. 1B is a schematic sectional view of the image forming apparatus and which a Y color developing cartridge is moved to a developing position.

The color image forming operation on the recording material 40 is as follows. FIG. 1A shows a stand-by state of the apparatus 100. A control circuit portion (unshown) rotates the drum 71 in the direction of an arrow B in synchronism with rotation of the belt 3 in the direction of an arrow A. The peripheral speeds of the belt 3 and the drum 71 are substantially the same. The surface of the drum 71 is uniformly charged to a predetermined polarity by charging means 73, and is exposed to light corresponding to a Y color component image of color image information. By this, an electrostatic latent image corresponding to the Y color component image is formed on the drum 71. In synchronism with formation of the electrostatic latent image, the rotary 1 is rotated in the direction of an arrow C by a rotary gear 17 about a rotation shaft or rotational axis 1*a*. The rotation of the rotary 1 is stopped at such a position in which the Y color developing cartridge 5*a*, to a developing position X where the color developing cartridge 5*a* is opposed to the drum 71 of shown in FIG. 1B. In the state, the developing roller 51 which is the developer carrying member of the color developing cartridge 5*a* and a toner supplying roller 52 which is the developer feeding member for the developing roller 51 are rotated, and a predetermined developing bias voltage is supplied to the developing roller 51. By doing so, there is provided a potential difference between the drum 71 and the developing roller 51 so that the Y chromatic toner is deposited on the electrostatic latent image formed on the drum 71. Thus, the Y chromatic toner is deposited on the electrostatic latent image molded on the drum 71, that is, the electrostatic latent image is developed. In other words, a Y chromatic toner image is formed on the drum 71. The primary transfer roller 4 is supplied with a predetermined primary transfer bias of the polarity opposite that of the charge polarity of the toner. By doing so, the Y chromatic toner image is primary-transferred sequentially onto the belt 3. When the primary transfer of the Y chromatic toner image onto the belt 3 from the drum 71 in this manner is completed, the control circuit portion rotates the rotary 1 in the direction of an arrow C, and brings the M color, C color and B color developing cartridges 5*b*, 5*c*, 5*d* to the developing position X where they oppose to the drum 71, sequentially. Similarly to the case of the Y color component image, the formation of the electrostatic latent image, the development and a primary transfer onto the belt 3 are executed sequentially. By this, a color toner image is formed by the superimposed Y, M, C, and B toner images on the belt 3. During the period of the synthetic formation of the color toner image on the belt 3, the secondary transfer roller 6 urged toward the transfer opposing roller 31 through the belt 3 is kept in the non-operating position in which it is spaced from the belt 3 as indicated by the solid line in FIG. 1A. The cleaning unit 10 is also in a non-operating position in which it is spaced from the belt 3 as indicated by solid lines in FIG. 1B.

Figure 2A:
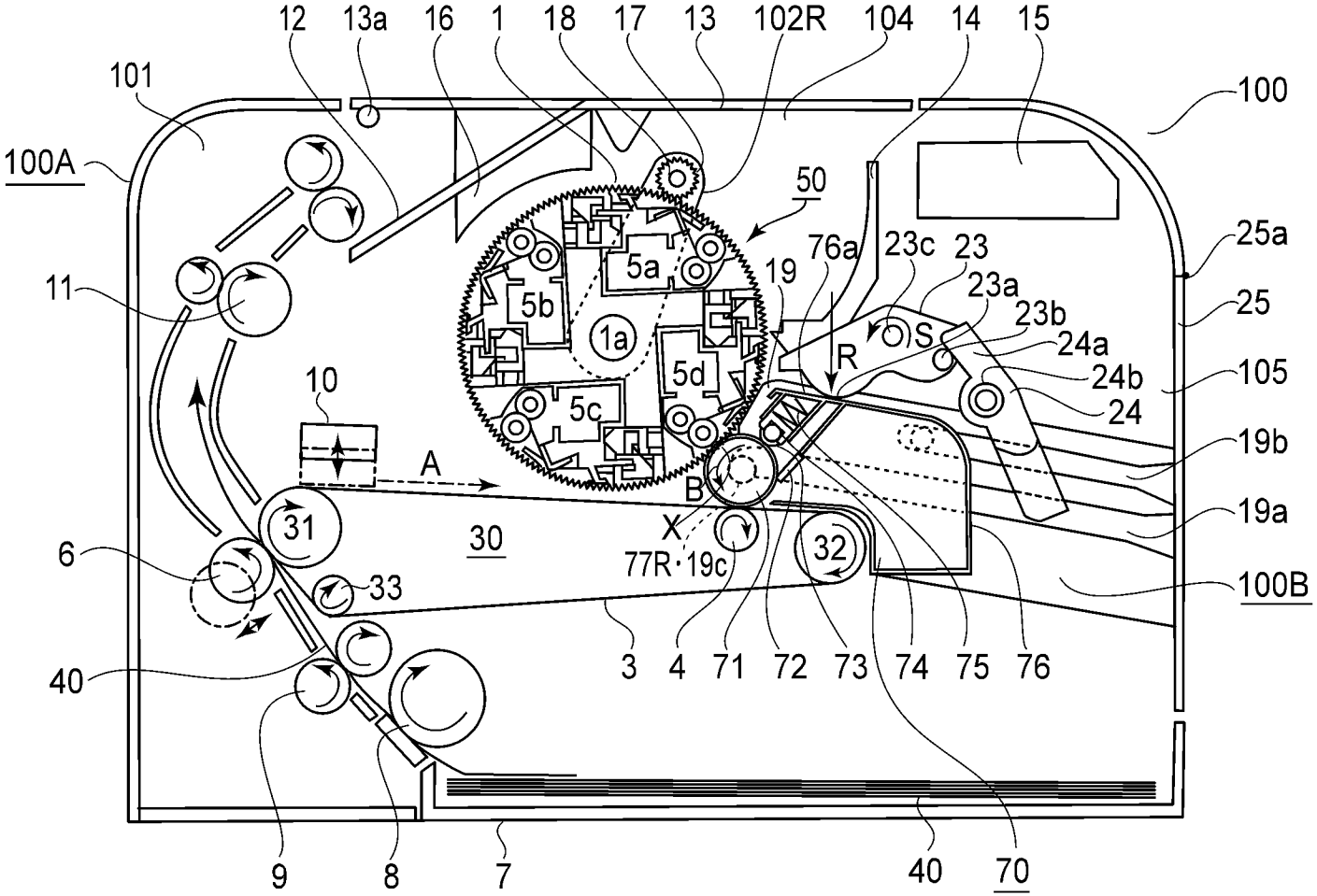
FIG. 2A is a schematic sectional view of the image forming apparatus when the B color developing cartridge is moved to the developing position.

On the other hand, the control circuit portion drives the feeding roller 8 at predetermined control timing to separate and feed a recording material 40 from the cassette 7 to the registration rollers 9. As shown in FIG. 2A, the secondary transfer roller 6 is brought into an operating position in which the secondary transfer roller 6 is urged toward the secondary transfer opposing roller 31 to press-contact the belt 3 to the secondary transfer opposing roller 31. The registration rollers 9 feed the recording material 40 into a secondary transfer nip formed by the secondary transfer roller 6 and the belt 3, and the secondary transfer roller 6 is supplied with a secondary transfer bias of a predetermined voltage and a polarity opposite the charge polarity of the toner. By this, the synthetically formed color toner image is transferred (secondary transfer) onto the belt 3 all together. The recording material 40 coming out of the secondary transfer nip is separated from the belt 3 and fed to the fixing device 11. In the fixing device 11, heat and pressure are applied to the recording material 40 to fix the toner image on the recording material. In this matter, of full-color image is formed on the recording material. The recording material 40 is discharged to a sheet discharge portion 12. The secondary transfer roller 6 is restored to the non-operating position when the trailing end of the recording material 40 passes through the secondary transfer nip and is kept there. The cleaning unit 10 is moved, in synchronism with the reaching of the leading end portion of the recording material 40 to the secondary transfer nip, to the operating position in which it acts on the belt 3. By this, the secondary untransferred toner remaining on the belt 3 without being transferred onto the recording material 40 is removed by the unit 10. And, when the trailing end of the recording material 40 passes through the secondary transfer nip, the unit 10 is restored to the non-operating position and is held there. The order of formations of the chromatic toner images on the drum 71 is not limited to the above-described order. Monochromatic image formation can be carried out.

(Rotary)

Figure 2B:
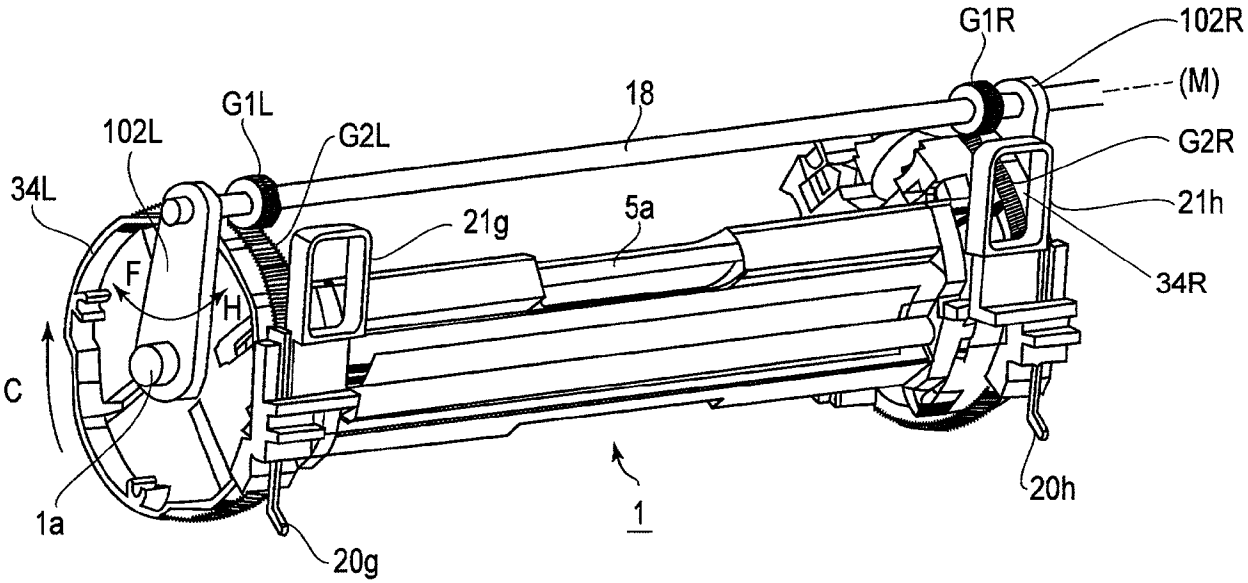
FIG. 2B is a perspective view of an outer appearance of a rotary, a separating member and an engageable member.

Referring to FIG. 2B, the structure of the rotary 1 according to an embodiment of the present invention will be described. The rotary 1 includes a rotational shaft 1*a* which is elongated in the left-light direction, and a pair of disks (left and right side plates) 34L, 34R which are concentrically and integrally provided to the shaft at the left and right sides. Here, the left-hand and the right-hand are based on the direction seeing the apparatus 100 from the front side (front cover 25 side). Each of the inner surfaces of the left and right disks 34L, 34R is provided with a mounting portion (four mounting portions in total) along the disk circumference, and the mounting portions are effective to detachably support the longitudinal end portion to the developing cartridges 5*a*, 5*b*, 5*c* and 5*d*. Between left and right side plates of an apparatus frame 101 of the main assembly 100A of the apparatus, a driving shaft 18 is rotatably supported by bearing members (unshown). A left-hand end portion and a right-hand end portion of the driving shaft 18 are provided with supporting members 102L, 102R, respectively. The rotational shaft 1*a* is rotatably supported between the supporting members 102L, 102R, by which the rotary 1 is supported. The developing cartridges 5*a*, 5*b*, 5*c*, 5*d* are detachably mounted to the predetermined positions between the disks 34L, 34R, so that they are disposed concentrically in a generally cylindrical form. Outer circumferences of the disks 34L, 34R are formed into rotary gears G2L, G2R, respectively. The left-hand end portion and the right-hand end portion of the driving shaft 18 are provided with respective drive gears G1L, G1R fixed thereto. The left side drive gear G1L is in meshing engagement with the left side rotary gear G2L, and the righthand side drive gear G1R is meshing engagement with the righthand side rotary gear G2R. The driving shaft 18 is rotated by a driver M controlled by the control circuit portion. With such a structure, when the driving shaft 18 is driven by the driver M in the predetermined direction, the rotational force of the driving shaft 18 is transmitted to the rotary gears G2L, G2R through the drive gears G1L, G1R. By this, the rotary 1 is rotated about the rotational shaft 1*a* in a forward rotational direction C. The control circuit portion controls the driver M to rotate the rotary 1 at predetermined angles. Since the rotary 1 is suspended by the left and right supporting members 102L, 102R, the rotary 1 is rotatable about the driving shaft 18 in the counterclockwise direction indicated by an arrow H and in the clockwise direction indicated by an arrow F. The swing of the rotary 1 in the counterclockwise direction H is toward the drum 71, and the swing in the clockwise direction F is away from the drum 71. The rotary 1 is normally urged in the counterclockwise direction indicated by the arrow H about the driving shaft 18. By the urging, the developing roller of the developing cartridge moved to the developing position X by the indexing rotation of the rotary 1 can be contacted uniformly to the drum 71. That is, the developing roller is contacted to the drum 71 with a predetermined pressure. The drive gears G1L, G1R engaged with the rotary gears G2L, G2R are concentric with the driving shaft 18 which is an axis of swing motion of the rotary 1. Therefore, the pivoting action of the rotary 1 does not result in disengagement from the rotary gears G2L, G2R. The structure for mounting and dismounting the developing cartridges 5*a*, 5*b*, 5*c*, 5*d* to the cartridge mounting portions of the rotary 1 may employ a known structure, and therefore, the detailed description thereof is omitted.

(Developing Cartridge)

Figure 3:
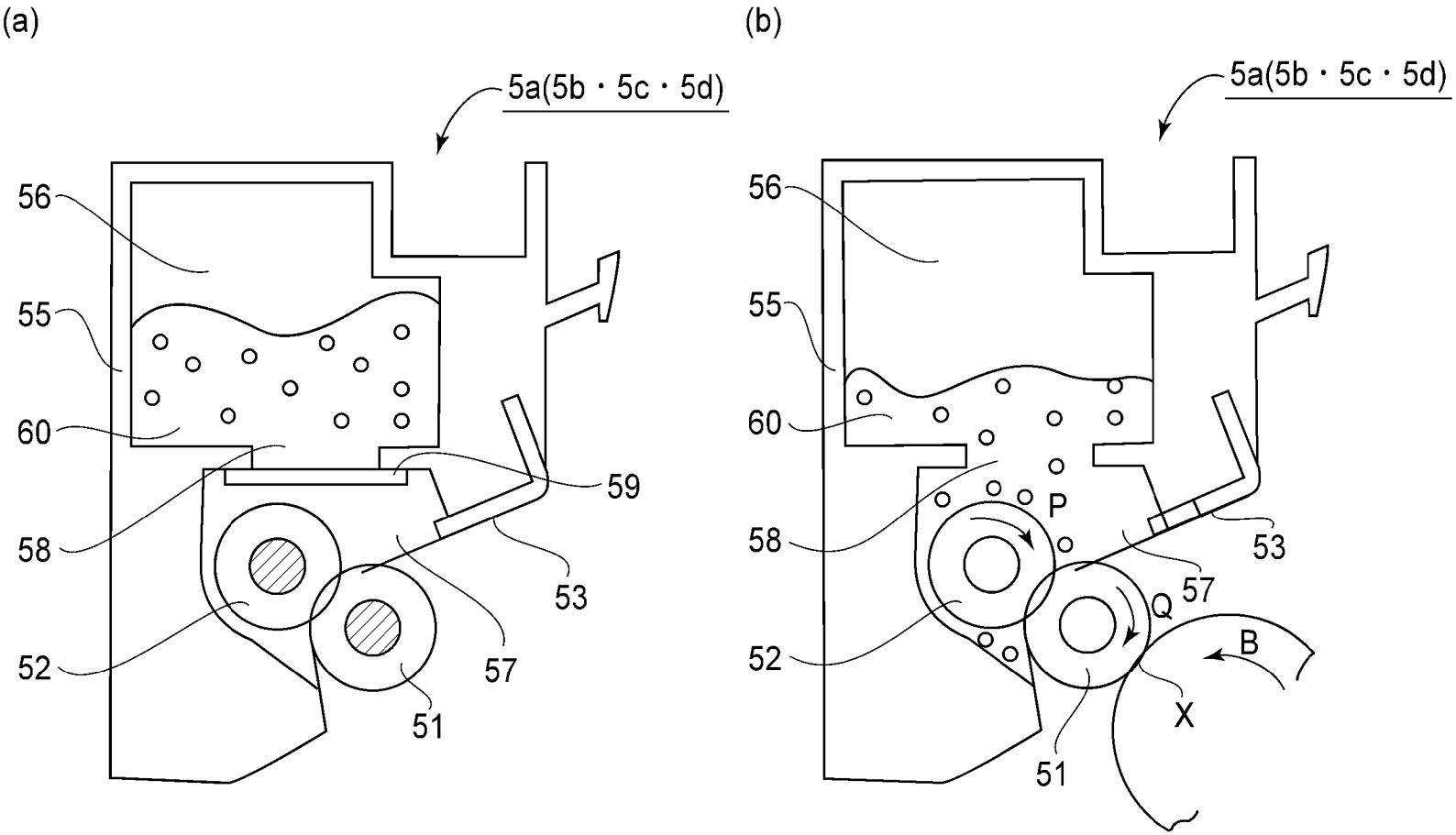
FIG. 3 illustrates a developing cartridge.

The structures of the developing cartridges 5*a*, 5*b*, 5*c*, and 5*d* are common with each other. Therefore, the structure of the developing cartridge will be described with respect to the Y color developing cartridge 5*a* of this embodiment. Parts (a) and (b) of FIG. 3 are sectional views of the developing cartridge 5*a*. The developing container 55 is divided into a toner accommodation chamber 56, and a developer chamber 57 including a developing roller 51 and a toner supplying roller 52, by a toner supply opening 58, in a vertical direction. In the unused state before the developing cartridge 5*a* reaches the user, a toner seal 59 in the form of film is fixed to the developing container 55 to seal the toner supply opening 58 by welding or the like, thereby to separate between the toner accommodation chamber 56 and the developer chamber 57, as shown in (a) of FIG. 3. By removing the toner seal 59 before start of use, the toner 60 is let fall into the developer chamber 57 from the toner accommodation chamber 56 in a developing position X where developing cartridge 5*a* opposes to the drum 71. The toner 60 is supplied to a toner supplying roller 52 from the developer chamber 57. The roller 52 rotates in the clockwise direction indicated by an arrow P to supply the toner 60 to the developing roller 51 and scrape the toner from the roller 51. The roller 51 comprises an elastic rubber roller and rotates in the clockwise direction indicated by an arrow Q, and the toner 60 on the roller 51 is regulated by the developing blade 53 and then is supplied to the drum 71 in the developing position X to develop the electrostatic latent image. The toner 60 remaining on the roller 51 after the development is removed by the roller 52 in a contact sliding portion between the roller 51 and the roller 52. Thereafter, the roller 51 is supplied with the toner by the roller 52. In order to stably contact the developing roller 51 to the drum 71 in the developing position X, a whole rotary 1 holding the developing cartridges 5*a* is urged toward the drum 71 (direction H, FIG. 4). By doing so, the developing roller 51 of the developing cartridge 5*a* is contacted to the drum 71 at a predetermined pressure.

(Drum Cartridge)

Figure 4:
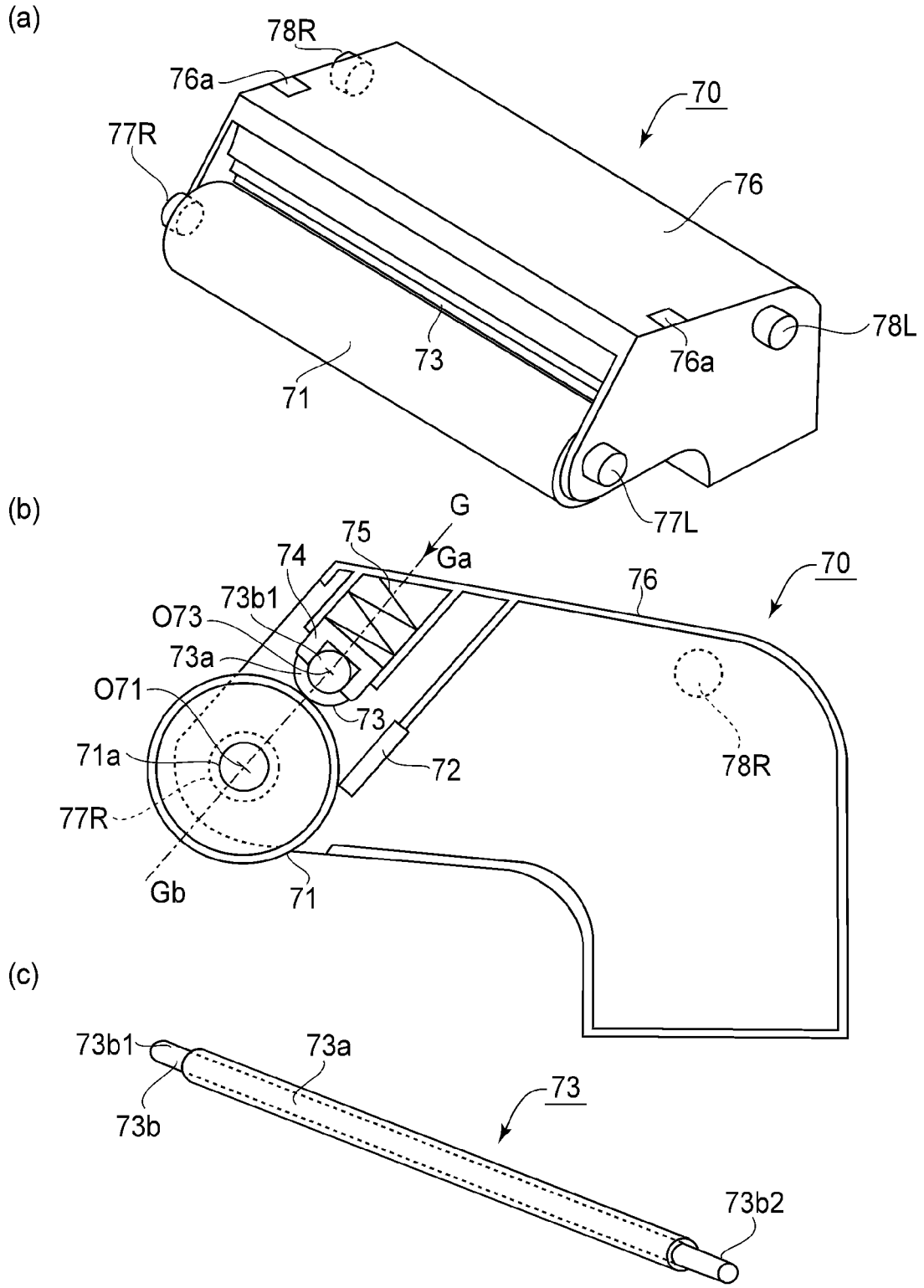
FIG. 4 illustrates a drum cartridge.

Referring to FIG. 4, the drum cartridge 70 will be described. Part (a) of FIG. 4 is a perspective view of an outer appearance of the drum cartridge 70 according to the embodiment, (b) is a cross-sectional view thereof, and (c) is a perspective view of charging means 73. The drum cartridge 70 comprises as a unit the drum 71, the charging means 73 and the cleaning means 72, and is demountable (detachably mountable) relative to a predetermined mounting portion 100B (FIG. 1) of the main assembly 100A of the apparatus. The drum cartridge 70 is positioned and held at a predetermined position of the main assembly 100A of the apparatus. Charging means 73 uniformly charged the drum 71 to a predetermined polarity and potential as preparation for formation of the electrostatic latent image. The cleaning means 72 removes that untransferred toner from the drum 71 and accommodates the removed toner into a drum cartridge frame (cleaner container) 76. Referring to (b) when (c) of FIG. 4, the description will be made as to the structure of the charging means 73. In this embodiment, the charging means 73 is of a charging roller type (contact charging). The description will be made as to a charging roller as the charging means 73. The charging roller 73 comprises a rubber roller portion 73*a* and a rigid shaft 73*b*, wherein the rigid shaft 73*b* penetrates the rubber roller portion 73*a* in the axial direction of the drum 71, and the opposite ends thereof are formed into projected portions 73*b*1, 73*b*2 projecting from the rubber roller portion 73*a*. The charging roller bearing 74 are mounted to the frame 76 so that the center of the charging roller 73 is movable on a line Ga-Gb passing through the center O73 of the charging roller 73 and the center O71 of the drum 71. A projected portion 73*b*1 of the charging roller 73 is rotatably supported by the bearing 74 which is passed in the direction of an arrow G, that is, toward the drum 71. The projected portion 73*b*2 is also pressed toward the drum 71 with a similar structure.

The left and right of the rotational shaft 71*a* of the drum 71 ends are supported rotatably through left and right bearings 77L, 77R between left and right side plates of the frame 76. The bearings 77L, 77R are projected outwardly from the side plates and function as portions-to-be-positioned. An outer surface of each of the side plates of the frame 76 is provided with projections 78L, 78R as portions-to-be-guided at symmetrical positions. The projections 78L, 78R are disposed downstream of the portion-to-be-positioned 77L, 77R with respect to the mounting direction of the drum cartridge 70 to the main assembly 100A of the apparatus. In the drum cartridge mounting portion 100B in the main assembly 100A of the apparatus, each of the inner surfaces of the side plates of the apparatus frame 101 is provided with a guiding member 19 for supporting and guiding the drum cartridge 70 for mounting and demounting of the cartridge. Each of the left and right guiding members 19 is provided with a first guide groove portion 19*a* engageable with portion-to-be-positioned 77L, 77R of the drum cartridge 70, and a second guide groove portion 19*b* engageable with the projection 78L, 78R. The first guide groove portion 19*a* and the second guide groove portion 19*b* extend from the front side opening 105 of the main assembly 100A of the apparatus toward the rotary 1. A rotary side end of the first guide groove portion 19*a* of each of the guiding member 19 is provided with a recess 19*c* as a positioning portion. The drum cartridge 70 is kept positioned relative to the main assembly 100A of the apparatus by being pressed by the urging member 23 in the state that portion-to-be-positioned 77L, 77R is in engagement with the recess 19*c*. In the state shown in FIGS. 1A, 1B, 2A and 2B in which the drum cartridge 70 is mounted to a mounting portion 100B of the main assembly 100A of the apparatus, the drum cartridge 70 is supported between the left and right guiding members 19 through the portions-to-be-positioned 77L, 77R and the portions-to-be-guided 78L, 78R. The portions-to-be-positioned 77L, 77R of the drum cartridge 70 are engaged with the recesses 19*c* as the positioning portions of the first guide groove portions 19*a*. Thus, the drum cartridge 70 is urged by the urging member 23 to be kept positioned relative to the main assembly 100A of the apparatus. The urging members 23 are provided symmetrically on the left and right guide portions 19, respectively. The urging members 23 are urged in the direction of an arrow S by springs (unshown) as urging members provided on a rotational shaft 23*c*. By doing so, the urging surface 23*a* of the urging member 23 contacts to the surface 76*a* to be contacted provided on the left-hand right-hand sides of the upper surface portion of the frame 76 of the drum cartridge 70 to urge the drum cartridge 70 in the direction of an arrow R. The direction of the arrow R is a direction of rotating the drum cartridge 70 about the projections 78L, 78R to press-contact portions-to-be-positioned 77L, 77R to the recess 19*c*. In this state, the drum cartridge 70 is kept positioned in the predetermined position relative to the main assembly 100A of the apparatus, in which the primary transfer roller 4 is press-contacted toward the drum 71 through the belt 3.

Figure 5A:
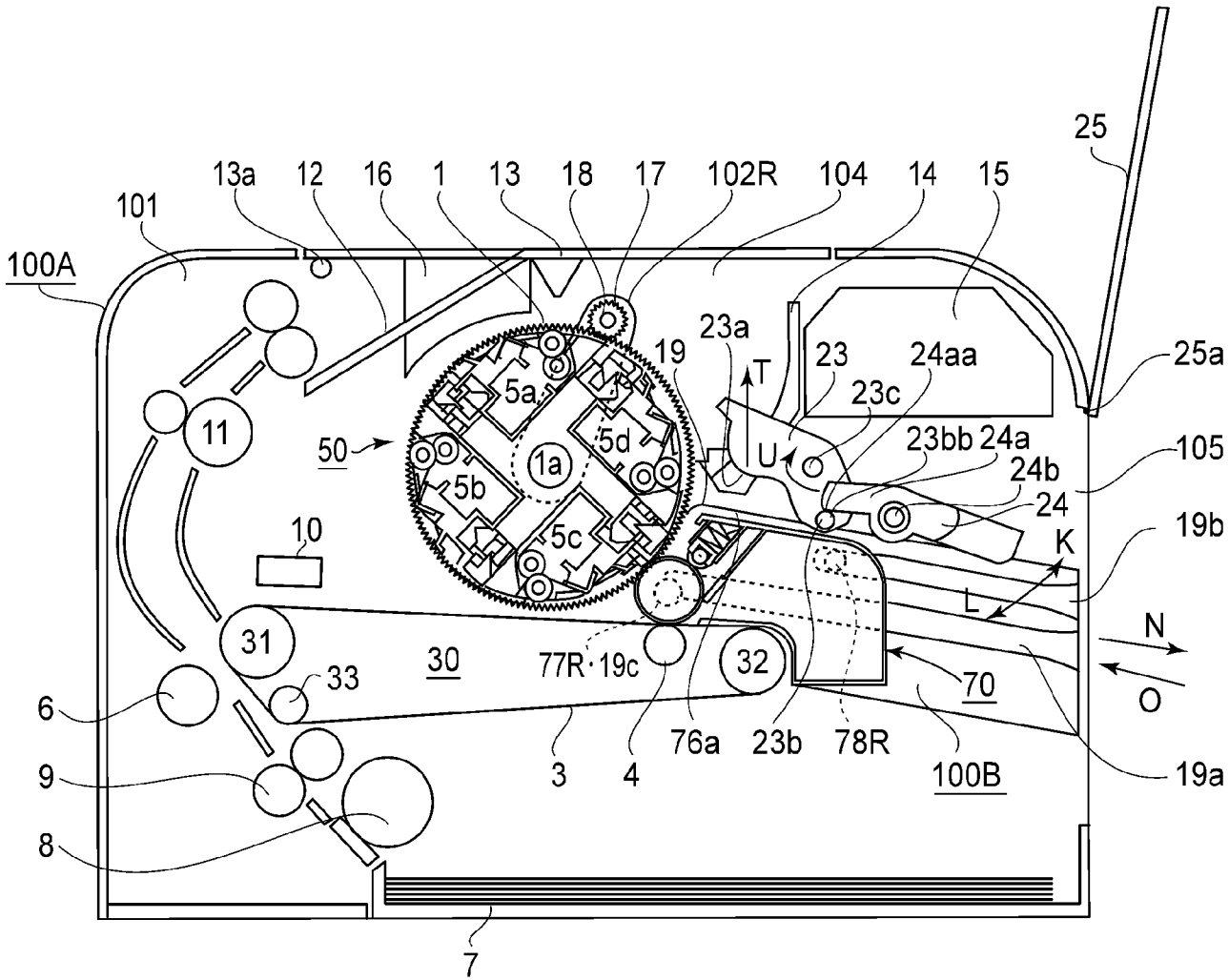
FIG. 5A illustrates a mounting and demounting operation manner of the drum cartridge.
Figure 5B:
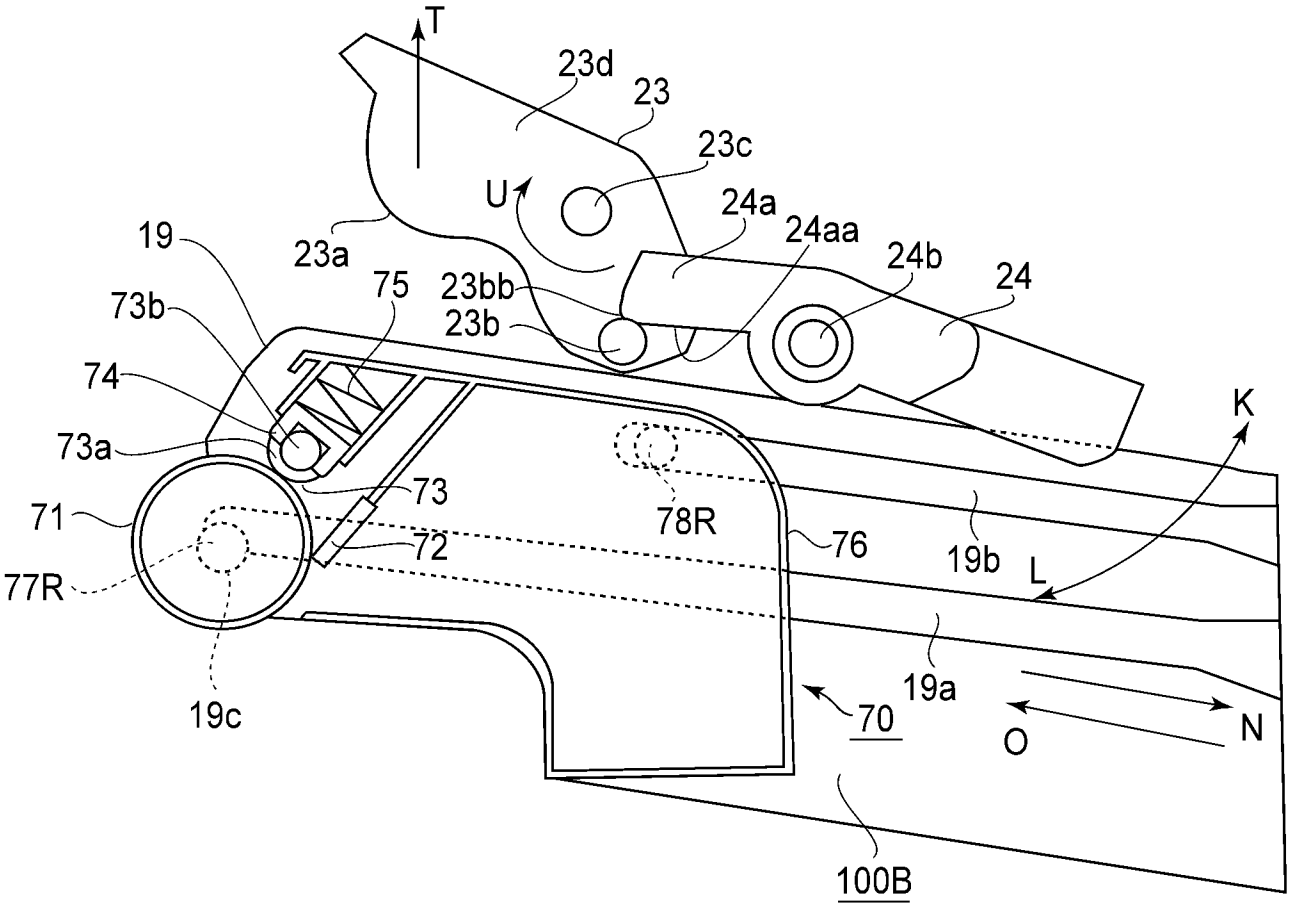
FIG. 5B is a partial enlarged view of FIG. 5A.

When the mounted drum cartridge 70 is to be taken out of the main assembly 100A of the apparatus, the front cover 25 is rotated about the hinge portion 25*a* to wide open the front side opening 105 of the main assembly 100A of the apparatus. When the front cover 25 is opened, the opening state thereof is held by a click stop mechanism (unshown). Then, the drum cartridge mounting portion 100B in the main assembly 100A of the apparatus can be seen through the opening 105. The user inserts his or her hand into the main assembly 100A of the apparatus through the opening 105, and manually rotates the levers 24 symmetrically provided at the left and right sides of the mounting portion 100B in the direction of an arrow K about a rotational shaft 24*b*, respectively. FIG. 5B is a partial enlarged view of FIG. 5A. By the rotation of the lever 24, a contact surface 24*aa* of the lever arm portion 24*a* is brought into contact to a second surface 23*bb* to be contacted of the projection 23*b* provided on the urging member 23, and the urging member 23 rotates about the shaft 23*b* in the direction of an arrow U against the urging force of the spring which is the above-described urging member. With this, the urging surface 23*a* moves in the direction of an arrow T so that the urging of the drum cartridge 70 by the left and right urging members 23 is released. In other words, the pushing of the portions-to-be-positioned 77L, 77R of the drum cartridge 70 to the positioning portion 19*c* of the main assembly 100A of the apparatus is released. When the lever 24 is rotated in the direction of the arrow K to a predetermined locking position, the locking mechanism (unshown) operates to look it to a locking position, and therefore, the lever 24 does not return even if it is freed. Thus, the urging member 23 is held in the non-urging state in which the drum cartridge 70 is not urged. Then, the drum cartridge 70 is gripped and pulled in the direction of the arrow N, that is, toward the front side opening 104. By this, the portions-to-be-positioned 77L, 77R and the portions-to-be-guided 78L, 78R, slides along the first guide groove portions 19*a* and the second guide groove portions 19*b* toward the opening 105, by which the drum cartridge 70 is taken out of the main assembly 100A of the apparatus through the opening 105. When the drum cartridge 70 is to be mounted, the drum cartridge 70 is inserted into the main assembly 100A of the apparatus through the opening 105 in the direction of an arrow O. The portions-to-be-positioned 77L, 77R and portions-to-be-guided 78L, 78R are engaged with the first guide groove portions 19*a* and the second guide groove portions 19*b* of the guiding members 19, and the drum cartridge 70 is pushed into the main assembly 100A of the apparatus. When the drum cartridge 70 is pushed enough, the portions-to-be-positioned 77L, 77R are engaged with positioning portions 19*c* of the first guide groove portions 19*a* at the leading ends. In this state, the user unlocks the left and right levers 24 by returning a release member (unshown) in the direction of arrow L. By this, the urging member 23 rotates in the direction of an arrow S by an urging force of a spring (unshown) as the urging member about the shaft 23*c*, so that the urging surface 23*a* is brought into contact the surface-to-be-contacted 76*a* of the drum cartridge 70 to press the drum cartridge 70 downward in the direction of an arrow R. More particularly, the portions-to-be-positioned 77L, 77R of the drum cartridge 70 is pushed to the positioning portions 19*c* of the main assembly 100A of the apparatus, so that the drum cartridge 70 is kept positioned relative to the main assembly 100A of the apparatus. Then, the front cover 25 is rotated to close the opening 105. In this manner, the mounting of the drum cartridge 70 to the main assembly 100A of the apparatus is completed.

(Locking Member)

In this embodiment, when the user starts to use the apparatus 100, it is not necessary to mount or dismount the developing cartridges 5*a*, 5*b* or the drum cartridges 70, so that the usability is improved. To accomplish this, when the apparatus 100 is shipped and transported from the plant, the developing cartridges 5*a*, 5*b*, 5*c*, 5*d* are mounted to the rotary 1 without the toner seals 59. The rotary 1 is swingably supported by the supporting members 102L, 102R so that the developing roller 51 is assuredly contacted to the drum 71. Therefore, if an impact is imparted during the transportation, the rotary 1 may swing about the driving shaft 18 in the direction of the arrow F in FIG. 1A. That is, there is a liability that the rotary 1 swings to such an extent of hitting to the other parts, with the result of damaging the rotary 1 and the others. Under the circumstances, as shown in FIGS. 6A and 6B, a locking member 21 is provided to limit or regulate swing of the rotary 1 during shipment and transportation.

Figure 7B:
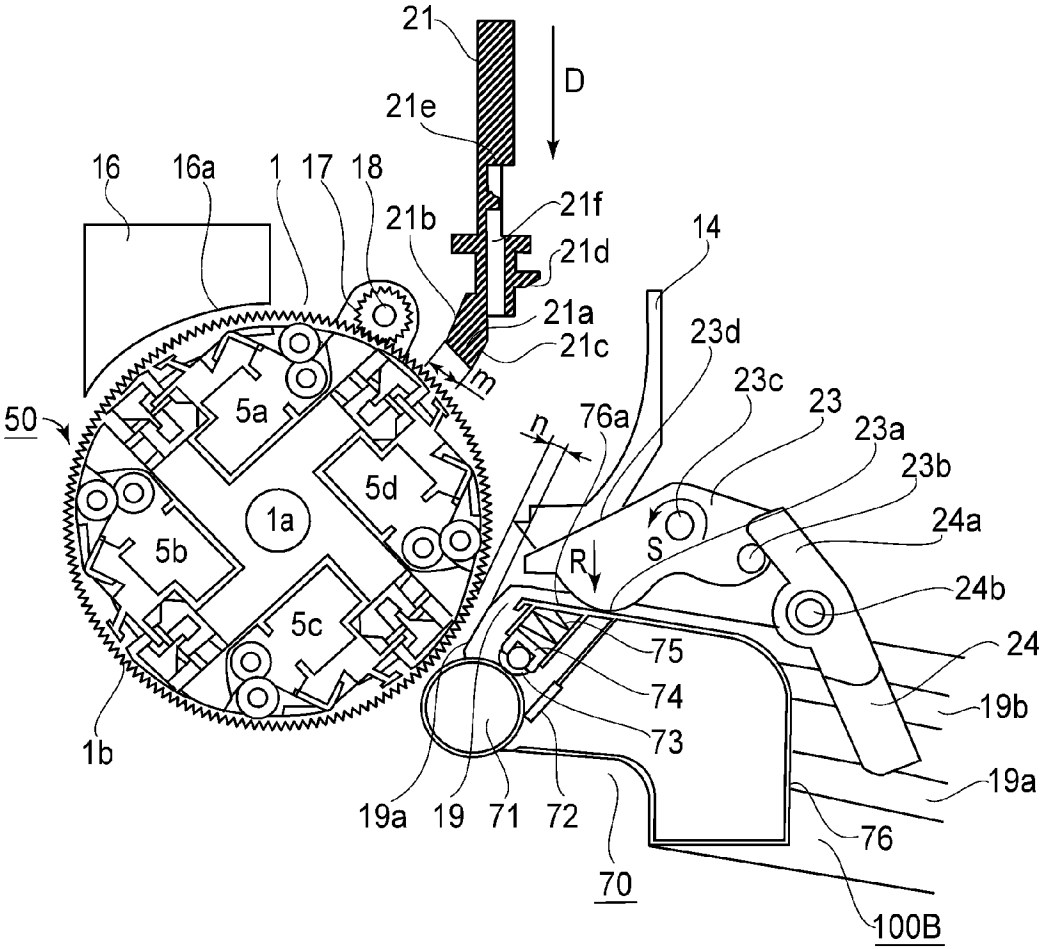
FIG. 7B is a partial enlarged view of FIG. 7A.
Figure 8A:
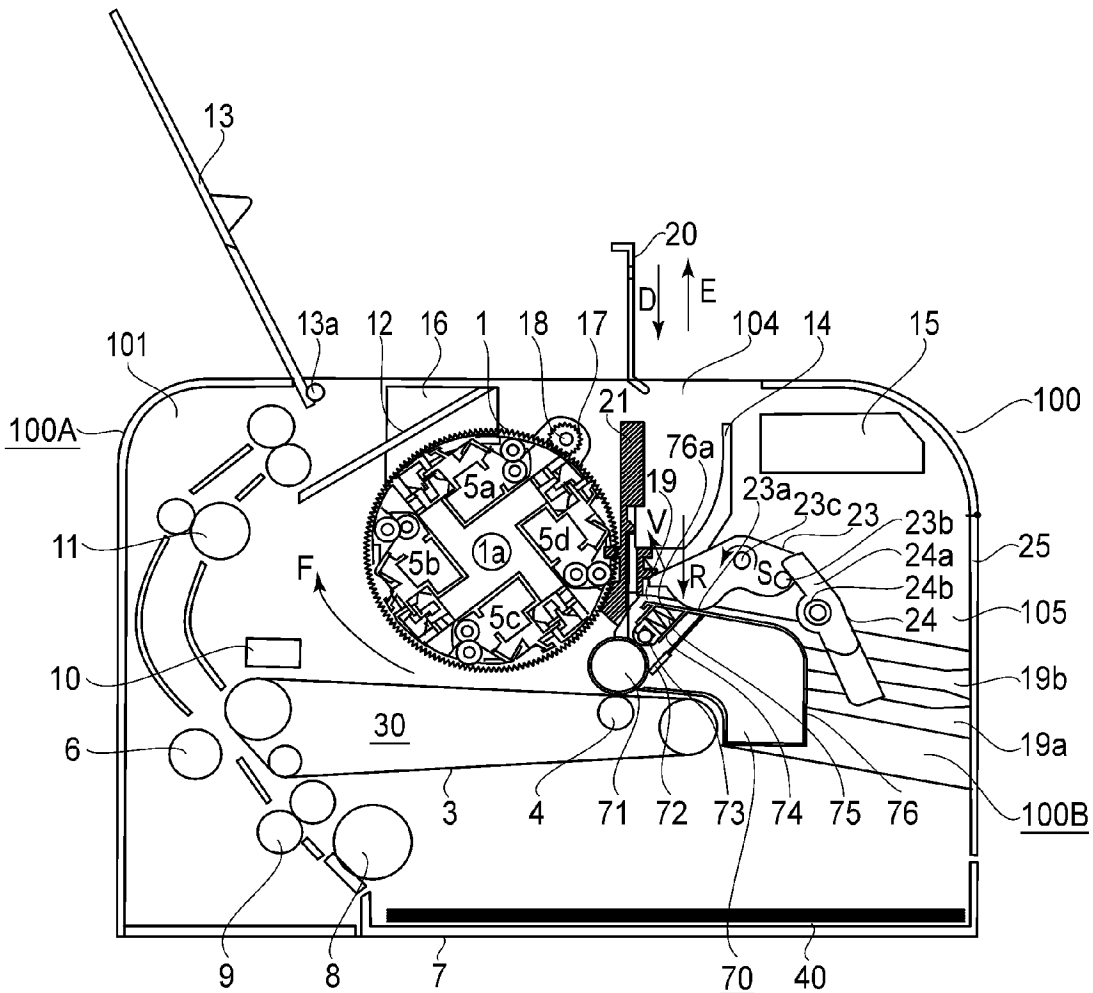
FIG. 8A illustrates a mounting manner of the spacer member.
Figure 8B:
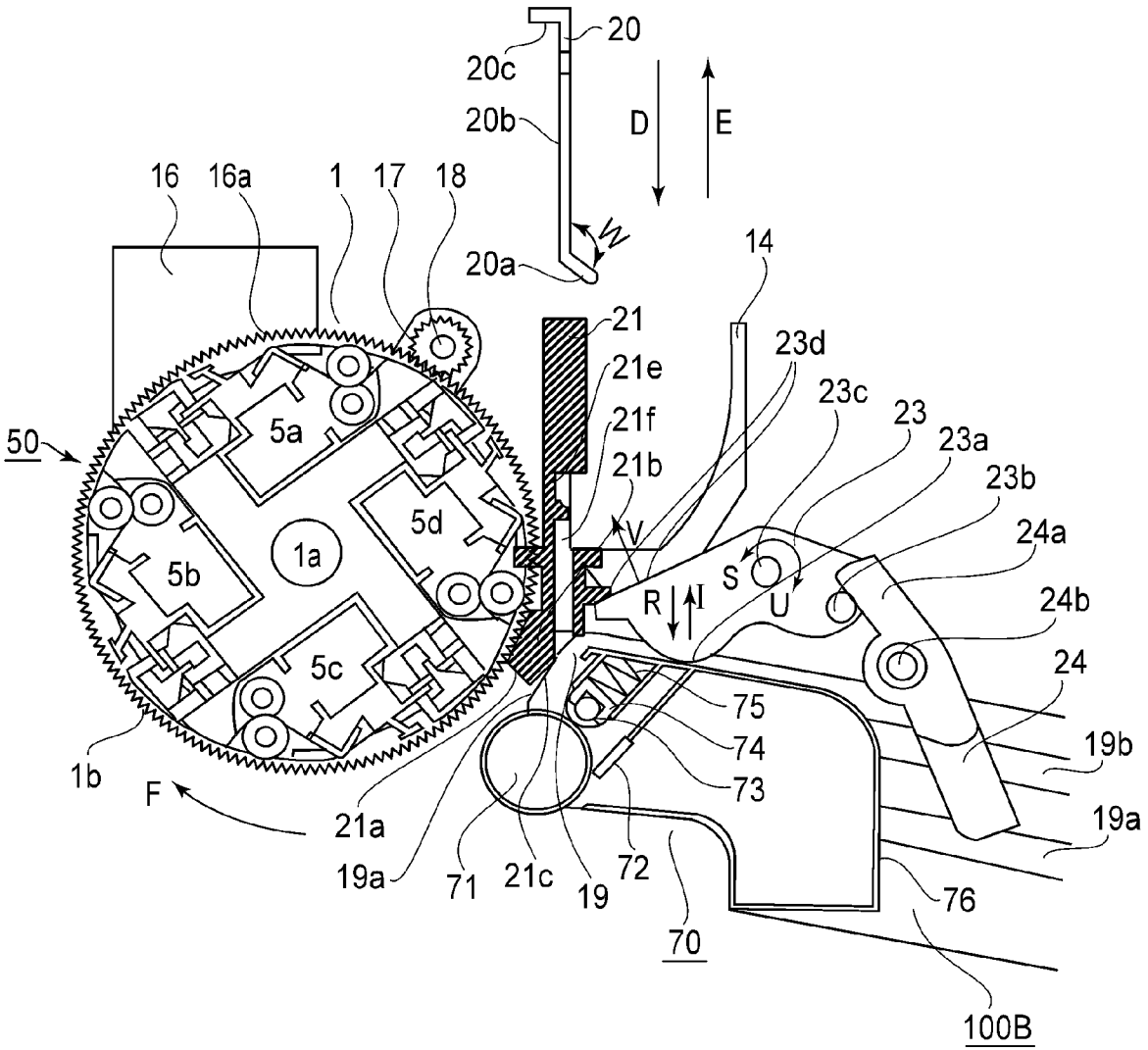
FIG. 8B is a partial enlarged view of FIG. 8A.

Referring to FIG. 7A, 7B and FIG. 8A, 8B, the description will be made as to the mounting of the locking member 21 into the apparatus 100. FIG. 7A is a sectional view illustrating mounting of the locking member 21 into the apparatus 100 in this embodiment. FIG. 7B is a partial enlarged view of FIG. 7A. FIG. 8A is a sectional view illustrating the state in which the locking member 21 is mounted to the apparatus 100. FIG. 8B is a partial enlarged view of FIG. 8B. As shown in FIGS. 7A and 7B, the locking member 21 is inserted between the rotary 1 and the guide 19 in the direction of the arrow D through an opening 104 which is opened by rotating the upper cover 13 of the apparatus 100 about the hinge portion 13*a*. FIGS. 8A and 8B show the state in which the locking member 21 is inserted between the rotary 1 and the guide 19 (mounted state). A first regulation of the regulating portion 21*a* of the locking member 21 is contacted to the outer surface 1*b* of the rotary 1, and the second regulating surface 21*c* is contacted to the regulating surface 19*a* of the guiding member 19. Here, a distance between the first regulating surface 21*b* and the second regulating surface 21*c* of the regulating portion 21*a* of the locking member 21 is m, and a distance between a surface-to-be-regulated 19*a* of the guiding member 19 and the outer surface 1*b* of the rotary 1 is n. Since the distance m is larger than the distance n, the rotary 1 swings in the direction of arrow F as shown in FIGS. 8A and 8B, so that the outer surface 1*b* of the rotary 1 is abutted to the regulating surface 16*a* of the fixing member 16 fixed at a predetermined position of the main assembly 100A of the apparatus to limit the swing motion of the rotary 1. At this time, a third regulating surface 21*d* of the locking member 21 is contacted to the first surface-to-be-regulated 23*d* of the urging member 23. Because of this, the urging member 23 is unable to rotate in the direction of an arrow U about the rotational shaft 23*b*, and therefore, the urging member 23 urging the drum cartridge 70 cannot be released. Therefore, with the locking member 21 mounted, the drum cartridge 70 cannot be taken out of the apparatus. In addition, even when a force is applied in the direction of rotating the urging member 23 in the direction of an arrow U in FIG. 5 about the rotational shaft 23*c*, the direction of the force applied to the third regulating surface 21*d* by the surface-to-be-regulated 23*d* is a direction of an arrow V in FIG. 8. For this reason, the direction is different from the direction of the arrow E which is the dismounting direction of the locking member 21, and therefore, the locking member 21 is not disengaged.

(Spacer Member)

Figure 6A:
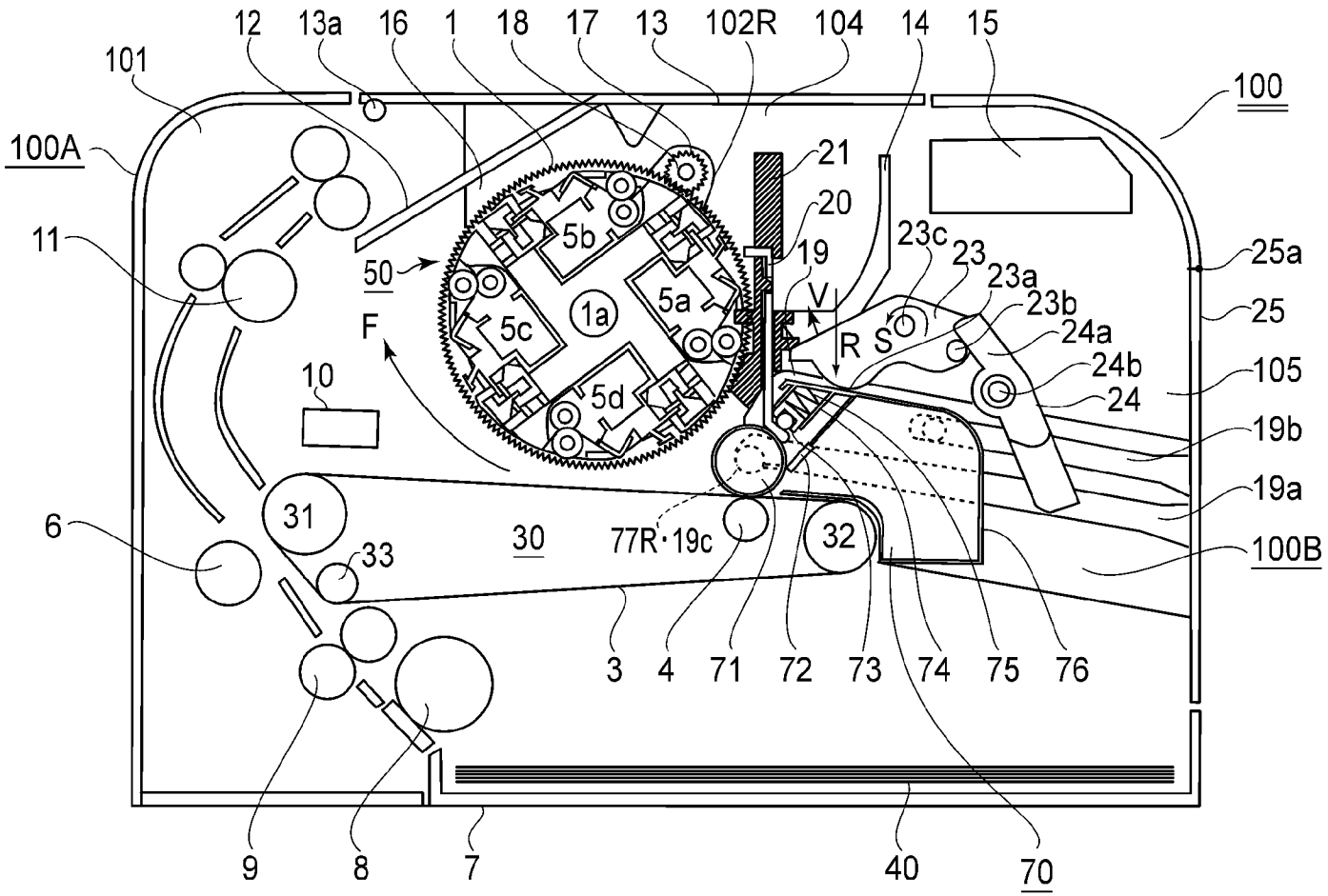
FIG. 6A is a schematic sectional view of the image forming apparatus in the state that the separating member and the locking member are mounted.
Figure 6B:
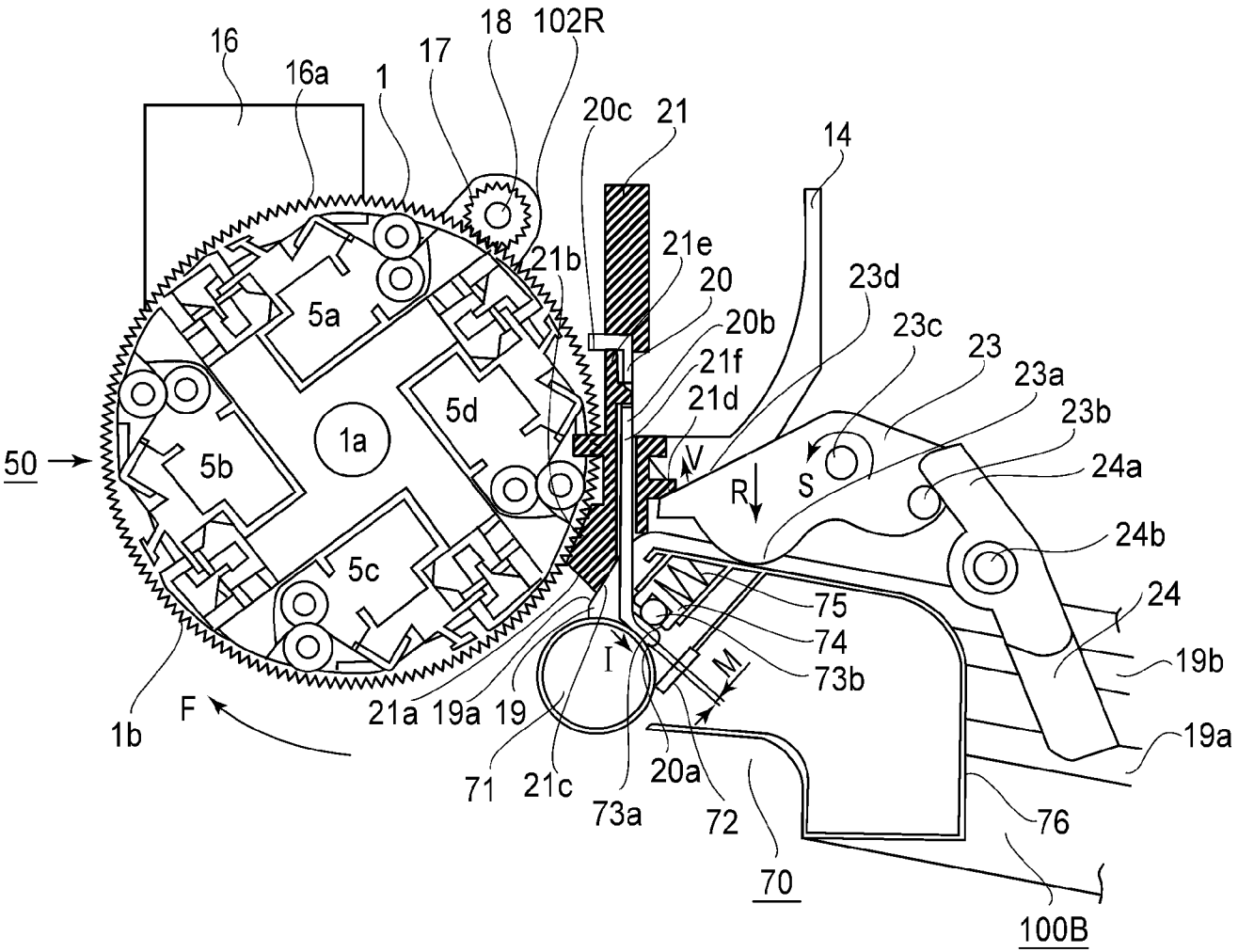
FIG. 6B is a partial enlarged view of FIG. 6A.

When the apparatus 100 is shipped and transported, the drum cartridges 70 are also mounted to the drum cartridge mounting portions 70 as shown in FIG. 6. In this case, the charging roller 73 is urged toward the drum 71 by the charging roller pressing member 20, and therefore, there is a liability that the rubber roller portion 73*a* is deformed before the apparatus 100 reaches the user. Therefore, it is desirable that the charging roller 73 is spaced from the drum 71 to prevent the deformation of the charging roller 73. In this embodiment, as shown in FIGS. 6A and 6B, a spacer member 20 is provided between the surface of the drum 71 and the projected portions 73*b*1, 73*b*2 Of the rigid shaft 73*b* constituting the charging roller 73, by which the distance between the surface of the drum 71 and the surface of the rubber roller portion 73*a* is kept M. Referring to FIGS. 6, 8, the mounting of the spacer member 20 into the apparatus 100 will be described. As shown in FIGS. 8A and 8B, the spacer member 20 is mounted through a through hole (guide portion) 21*f* provided in the locking member 21 in the direction of the arrow D after the locking member 21 is mounted. The spacer member 20 includes a spacing portion 20*a* and an arm (supporting portion) 20*b*, and when the spacer member 20 is mounted, the spacing portion 20*a* is guided by the through hole 21*f*. The spacing portion 20*a* is provided at an angle W relative to the arm 20*b*, but when it passes through the through hole 21*f*, the spacing portion 20*a* bends in the direction of increasing the angle W to permit passage thereof. In other words, the spacing portion 20*a* is movable relative to the arm 20*b*. As shown in FIGS. 6A and 6B, the spacing portion 20*a* abuts to the surface of drum 71 to receive a force in the ejection of the arrow I. By this, the spacing portion 20*a* moves in the direction of the arrow I and is mounted between the rigid shaft 73*b* and the drum 71. In FIGS. 2A and 2B, the locking member 21 and the spacer member 20 are shown as being mounted. In this embodiment, the locking member 21 (locking members 21*g*, 21*h*) is provided at each of the left and right end portion of the rotary 1 to limit the swing motion of the left and right disks 34L, 34R of the rotary 1. The spacer member 20 (spacer members 20*g*, 20*h*) is provided corresponding to each of the left and right locking members 21*g*, 21*h*.

(Removal of Locking Member and Spacer Member)

Figure 9A:
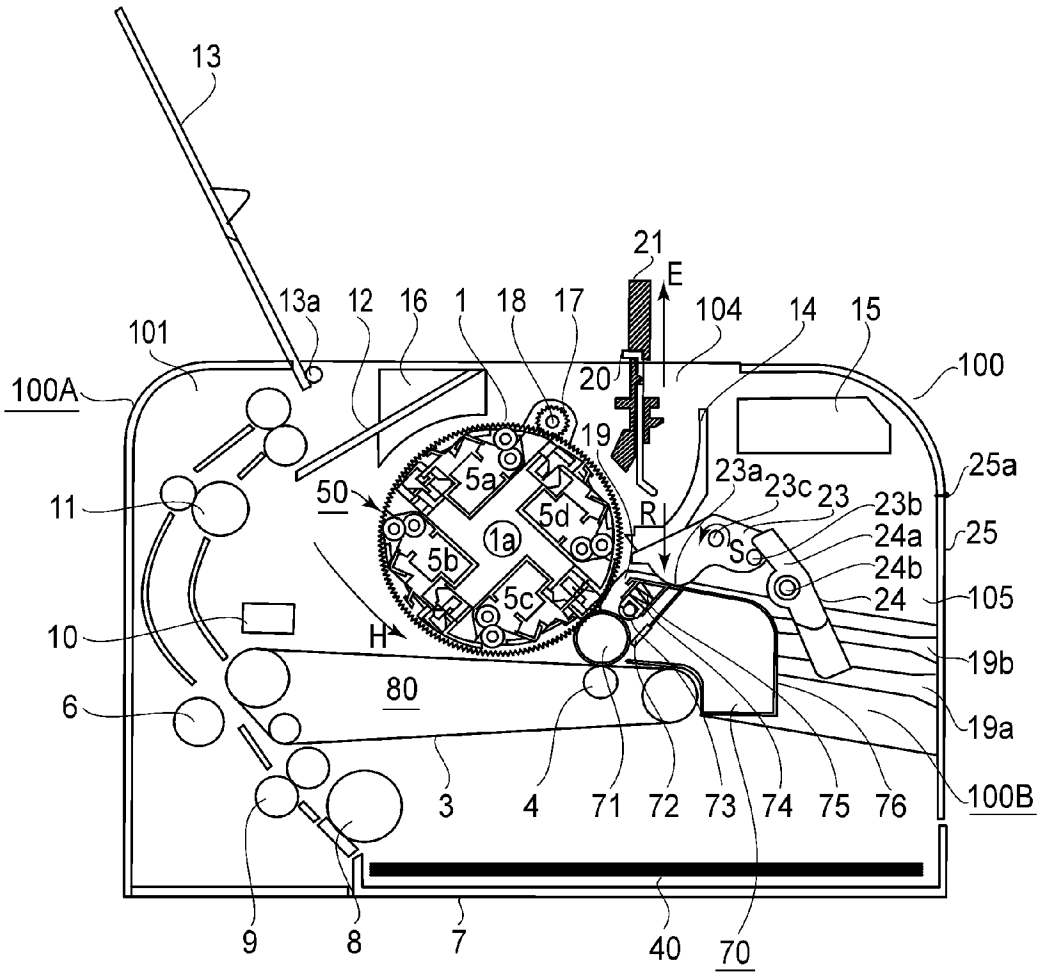
FIG. 9A illustrates an illustration of a dismounting manner of the locking member and the spacer member, and FIG. 9 B is a partial enlarged view of FIG. 9 A.
Figure 9B:
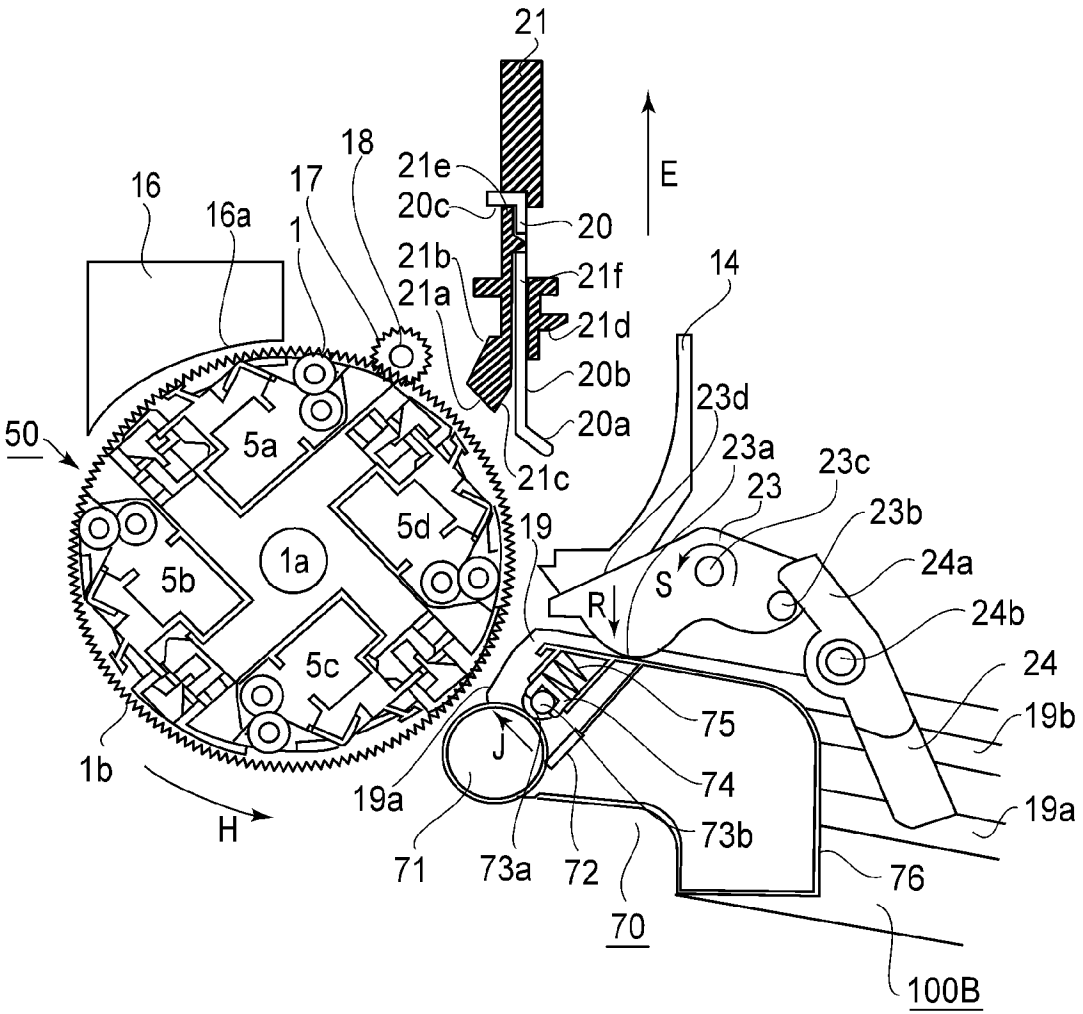

Referring to FIGS. 9A and 9B, the operation at the time of a user first installing the apparatus 100 will be described. FIG. 9A is a sectional view in which the locking member 21 and the spacer member 20 are dismounted from the apparatus 100. FIG. 9B is a partial enlarged view of FIG. 9A. The user is required to dismount the locking member 21 from the apparatus 100 at the initial installation. In this embodiment, the locking member 21 is provided with a contact surface (engaging portion) 21*e* contacted to the surface-to-be-contacted 20*c* of the spacer member 20. When the locking member 21 is removed in the direction of the arrow E, the spacer member 20 also moves in the direction of the arrow E since the contact surface 21*e* contacts to the surface-to-be-contacted 20*c*. Therefore, in this embodiment, the locking member 21 and the spacer member 20 can be dismounted integrally. By doing so, the spacing portion 20*a* is moved from between the rigid shaft 73*b* and the drum 72 in the direction of the arrow J by which the charging roller 73 is brought into contact to the drum 71 by the function of the charging roller pressing member 75. The removing direction E of the spacer member 20 and the moving direction J the spacing portion 20*a* are different from each other, but that arm 20*b* Deformable to accommodate this. Furthermore, the regulating portion 21*a* fixed between the outer surface 1*b* of the rotary 1 and the surface-to-be-regulated 19*a* of the guiding member 19 is also dismounted. Therefore, the rotary 1 moves in the direction of the arrow H to the regular position in which it is opposed to the drum 71. Finally, the upper cover 13 is closer to, by which the apparatus 100 is operative.

The apparatus 100 of this embodiment is summarized as follows.

It is an electrophotographic image forming apparatus 100 for forming an image on a recording material 40. Said apparatus comprising:

(i) a drum cartridge 70 including an image bearing member 71 and charging means 73 for charging a surface of said image bearing member, said drum cartridge being demountably mounted to a main assembly 100A of the electrophotographic image forming apparatus;

a rotary 1 supporting a plurality of developing means 5 each having a developer carrying member 71 for developing an electrostatic latent image formed on said image bearing member, said rotary being swingably mounted to said main assembly of the apparatus through a supporting member 102L, 102R and being rotatable, relative to said supporting member, to bring said developing means to a developing position X for developing the electrostatic latent image;

(iii) a spacer member 20 for spacing between said charging means and the surface of said image bearing member, said spacer member being mounted between said image bearing member and said charging means; and (iv) a locking member 21 for spacing between said developing means positioned in the developing position and said image bearing member, said locking member being demountably mounted between said drum cartridge and said rotary, and said locking member being is provided with a guide portion 21*f* for guiding said spacer member between said image bearing member and said charging means.

(v) said locking member 21 includes an engaging portion 21*e* engageable with said spacer member to dismount said spacer member from between said image bearing member and said charging means when dismounting said locking member from between said drum cartridge and said rotary.

(vi) said spacer member includes a spacing portion interposed between said image bearing member and said charging means, and a supporting portion for supporting said spacing portion.

According to this embodiment, (i) the locking member 21 limits the swing motion of the rotary 1, and therefore, it can be avoided that the rotary 1 collapses to parts of the apparatus 100 due to impact during the transportation with the result of damage of the rotary 1 and the parts.

(ii) there is provided a spacer member 20 for spacing between the image bearing member 71 and the charging means 73, by which the charging means 73 is prevented from the information, thus providing high image quality.

(iii) the spacer member 20 can be dismounted integrally with the locking member 21 for limiting the swing motion of the rotary 1, and therefore, the usability property is improved.

Therefore, according to the present invention, the rotary supporting the developing means is prevented from the swing motion, the rotary being packaged together with the main assembly of the electrophotographic image forming apparatus. In addition, the charging means packaged in the apparatus is prevented from the formation attributable to the press-contact of the charging means to the image bearing member. In addition, the releasing of the swing limitation and the releasing of the developer carrying member spacing which are to be carried out by the user upon the initial installation, can be made easy, by which the usability property can be improved.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 250060/2009 filed Oct. 30, 2009 which is hereby incorporated by reference.

What is claimed is:

1. An electrophotographic image forming apparatus for forming an image on a recording material, the apparatus comprising:

(i) a drum cartridge including an image bearing member and charging means for charging a surface of said image bearing member, said drum cartridge being demountably mounted to a main assembly of the electrophotographic image forming apparatus;

(ii) a rotary supporting a plurality of developing means each having a developer carrying member for developing an electrostatic latent image formed on said image bearing member, said rotary being swingably mounted to said main assembly of the apparatus through a supporting member and being rotatable, relative to said supporting member, to bring said developing means to a developing position for developing the electrostatic latent image;

(iii) a spacer member for spacing between said charging means and said surface of said image bearing member, said spacer member being mounted between said image bearing member and said charging means; and (iv) a locking member for spacing between said developing means positioned in the developing position and said image bearing member, said locking member being demountably mounted between said drum cartridge and said rotary, and said locking member being provided with a guide portion for guiding said spacer member between said image bearing member and said charging means.

2. An apparatus according to claim 1, wherein said locking member further comprises an engaging portion engageable with said spacer member to dismount said spacer member from between said image bearing member and said charging means when dismounting said locking member from between said drum cartridge and said rotary.

3. An apparatus according to claim 1, wherein said spacer member includes a spacing portion interposed between said image bearing member and said charging means, and a supporting portion for supporting said spacing portion.

4. An apparatus according to claim 3, wherein said spacing portion is provided at an angle W relative to said supporting portion, and said spacing portion is deformable such that an angle relative to said supporting portion is larger than W when said spacer member passes said guide portion.

5. An apparatus according to claim 1, wherein said guide portion is in the form of a through hole provided in said spacer member.

* * * * *